United States Patent [19]

Dietrich et al.

[11] Patent Number: 4,987,951

[45] Date of Patent: Jan. 29, 1991

[54] METHOD AND APPARATUS FOR THE VERTICAL CASTING OF METAL MELTS

[75] Inventors: Walter Dietrich, Hanau am Main; Klaus-Georg Dietrich, Darmstadt-Wixhausen, both of Fed. Rep. of Germany

[73] Assignee: Leybold Aktiengesellschaft, Hanau, Fed. Rep. of Germany

[21] Appl. No.: 301,166

[22] Filed: Jan. 24, 1989

[30] Foreign Application Priority Data

Sep. 2, 1988 [DE] Fed. Rep. of Germany ..... 3829810

[51] Int. Cl.[5] ..... B22D 11/16; B22D 37/00; B22D 41/08

[52] U.S. Cl. ..... 164/466; 164/147.1; 164/498; 164/502

[58] Field of Search ..... 164/466, 502, 500, 147.1, 164/498, 467; 222/590, 594

[56] References Cited

U.S. PATENT DOCUMENTS

| | | | |
|---|---|---|---|
| 2,970,830 | 2/1961 | Siegfried | 164/498 X |
| 3,177,536 | 4/1965 | Schneider | 164/502 |
| 4,082,207 | 4/1978 | Garnier et al. | 222/594 |
| 4,216,800 | 8/1980 | Garnier et al. | 164/500 X |
| 4,523,628 | 6/1985 | Vives | 164/504 X |
| 4,749,026 | 6/1988 | Metz et al. | 164/147.1 X |
| 4,762,653 | 8/1988 | Senillou et al. | 164/467 X |
| 4,842,170 | 6/1989 | Del Vecchio et al. | 222/594 |

FOREIGN PATENT DOCUMENTS

| | | | |
|---|---|---|---|
| 1041652 | 10/1958 | Fed. Rep. of Germany . | |
| 1166892 | 7/1985 | U.S.S.R. | 164/500 |

*Primary Examiner*—Richard K. Seidel
*Assistant Examiner*—J. Reed Batten, Jr.
*Attorney, Agent, or Firm*—Felfe & Lynch

[57] ABSTRACT

Molten metal passing through an outlet opening is guided in free fall by a magnetic field which rotates about the vertical axis of the opening to impress a rotation in the stream of molten metal. A further magnetic field rotating at the same rate but out of phase with the first can increase the rotation. At least one toroidal magnetic field coaxial with the rotating field can be used to shape the cross section of the pouring stream.

9 Claims, 2 Drawing Sheets

METHOD AND APPARATUS FOR THE VERTICAL CASTING OF METAL MELTS

BACKGROUND OF THE INVENTION

The invention relates to a method for casting metal melts from melt vessels having an outlet opening with a vertical axis for the melt that forms a pouring stream of molten metal.

Metal melts are usually allowed to emerge simply in free fall from melt vessels with bottom openings. The pouring stream of molten metal can be processed further in many ways. For example, it is possible to supply the pouring stream of molten metal to a casting mold, in which a complicated molded object is produced, or also to a block casting mold for the production of a block or ingot. To produce metal powder, it is furthermore possible to supply the pouring stream of molten metal to a centrifugal disk or an atomizer jet, which divides the pouring stream of molten metal into fine particles.

From the German Auslegeschrift 1,041,652 it is known to surround the vertical tubular elongation of the bottom opening of a crucible with a cylindrical induction coil in order to be able to interrupt the pouring stream of molten metal (using the pinch effect), so that the pouring stream of molten metal freezes due to the appropriate withdrawal of heat, and to melt the frozen "plug" subsequently once again by inductive heating with an appropriate frequency, so that casting can be recommenced.

The melt vessel may also be a so-called "funnel", in which the melt stays only a very short time for centering or for forming a pouring stream of molten metal with a defined cross section. Such a funnel usually has a ceramic interior surface or a lining to produce the required, thermal stability.

The positioning of the pouring stream of molten metal and the adjustment of the stream to one of defined cross section are required especially for so-called atomizing installations, in which a vertical pouring stream of molten metal concentrically enters an axially symmetrical jet system and in which the stream is divided into a fine powder by the supersonic flow of an inert gas. The previously used ceramic casting funnels are generally also heated in order to keep at a low value the temperature losses of the melt which arise due to contact with the inner wall of the funnel.

One of the disadvantages of these casting funnels is that the pouring stream of molten metal, on leaving the bottom opening or funnel mouth, frequently is not detached symmetrically. Moreover, the intensive contact of the melt with the interior, ceramic wall of the funnel is a disadvantage when end products must be produced which are completely free of ceramic. This requirement must be met very frequently in conjunction with heat-resistant and reactive metals and their alloys of high purity, as well as in the case of base nickel and cobalt alloys of high purity.

Attempts have also already been made to stabilize the vertical pouring stream of molten metal with higher precision without physical guiding elements. For example, by introducing probes and applying voltages the pouring stream of molten metal has been made into a conductor through which a current passes an on which magnetic force fields can act for the purpose of guiding the pouring stream. Through such measures, however, the pouring stream guidance is relatively slight and inaccurate. Moreover, the probes introduced into the pouring steam of molten metal cause spattering and turbulences thus destabilizing the pouring stream of molten metal.

SUMMARY OF THE INVENTION

It is therefore an object of the present invention to provide a method of the type described above, for producing a pouring stream of molten metal with a stable axis and a defined cross section and which moreover detaches itself precisely centrally from the lower edge of the outlet opening.

This object, as well as other objects which will become apparent in the discussion that follows, are achieved, in accordance with the present invention, by guiding the pouring stream of molten metal in free fall through at least one magnetic field which rotates about a vertical axis. In a particularly advantageous manner, a rotating magnetic field, similar to that known from the stators of socalled three-phase motors, is used. In this connection, it is particularly advantageous to use a rotary speed or a rotating frequency of between 50 and 500 Hz.

By means of the inventive method, a rotation is forced upon the pouring stream of molten metal during its free fall and, if necessary, also already previously while it is within the outlet opening or the tubular elongation of this outlet opening. The impressed rotation permits the pouring stream of molten metal to rotate about its own vertical axis, which is now aligned exactly straight. A very stable guidance of the pouring stream is achieved by these means, so that the pouring stream does not have the tendency to shift in the transverse direction or even to "flutter".

In precision casting, the inventive method has the advantage that the pouring stream of molten metal can also be introduced into very narrow mold openings of precision casting molds, as a result of which the erosion of the material forming the mold can be avoided, especially when this is a mineral material.

With particular advantage, however, the pouring stream can be positioned within an axially symmetrical atomizing jet for the production of metal powder. By these means, the particle spectrum of the powder can be narrowed greatly. With that, it is possible to fulfill an essential requirement of the processing of metal powder, namely to obtain as narrow a particle size spectrum as possible in order to be able to produce as homogeneous a compact as possible from the metal powder.

Usually, there is some "slippage" between the pouring stream of molten metal and the rotating magnetic field, at least in the upper part of the path of fall. Due to the eddy currents in the pouring metal stream associated therewith, a subsequent heating of the pouring stream of molten metal can be brought about in a desirable manner, so that it is no longer necessary to the same extent to overheat the melt before casting is commenced. Overheating of alloy melts has proven to be disadvantageous in many cases, since the composition of the alloy is frequently changed by the evaporation of more volatile alloying elements. This is particularly the case with highly reactive melts, which can be cast only in a vacuum or under a protective gas.

The guiding influence on the melt, as well as the rotational speed of the melt can be increased further in an advantageous manner owing to the fact that in the path of fall of the melt at least two rotating fields are used, which are disposed one on top of the other and which rotate with the same rotational speed but with offset phases. When two rotating fields are used, the phase angle preferably is 90°.

It is to be regarded as particularly advantageous that the stabilization of the pouring stream of molten metal is possible with the invention without having to insert probes into the path of fall of the melt, so that turbulence and spattering are reliably avoided. Owing to the fact that the rotation of the pouring stream commences already within the outlet opening or within the socket adjoining the outlet opening, the rotating pouring stream detaches itself axially symmetrically from the lower edge of the opening or from the casting funnel opening with great reliability.

The present invention also contemplates apparatus for carrying out the inventive method.

Such an apparatus, first of all, includes a conventional melt vessel with a closable outlet opening having a vertical axis for the formation of a vertically falling pouring stream of molten metal, as well as a magnetic device, which is disposed in the area of the outlet opening and surrounds the path of the melt.

To accomplish the objective of the invention the magnetic device is constructed as a rotating field generator with the center axis of the rotating field generator arranged coaxially with the axis of the outlet opening.

According to a further development of the present invention, such an apparatus can be improved by arranging at least one other magnetic device for generating a continuous, axially symmetrical magnetic field coaxially with the rotating field generator.

Due to the last-mentioned measure, electromagnetic, static or periodic guiding fields, axially symmetric to the path of fall of the pouring stream of molten metal, can precede, follow and/or be interposed or superimposed directly on the at least one rotating field. By these means, it is possible to shape the cross section of the pouring stream in the path of fall and to also maintain or continue this stream shape, if necessary, over a longer region of the path.

Such magnetic devices may, for example, be constructed similarly to electromagnetic electron lenses, that is, in the form of so-called cylindrical coils which are surrounded by a U-shaped yoke, the two legs of which run radially and are connected to one another in the region of the outer diameter by a hollow cylindrical yoke.

The circular currents which circulate in the cross section of the pouring stream and are induced in the inhomogeneous edge portion of the rotating field generators on passage of the pouring stream of molten metal, and the static magnetic fields of the additional magnetic devices generate concentric or centrifugal force components, which can also be used in a meaningful manner to guide the pouring stream.

The formation of a rotating magnetic field can be brought about by measures similar to those known from the stators of three-phase motors. It is particularly advantageous that the rotational speed can be adjusted so that, if necessary, also higher rotational speeds up to an order of magnitude of a few kilohertz can be used. For this purpose, a three-phase frequency generator is preferably provided, which can be constructed as a static combined final control element or also as a motor generator.

For a full understanding of the present invention, reference should now be made to the following detailed description of the preferred embodiments of the invention and to the accompanying drawings.

DESCRIPTION OF THE PREFERRED EMBODIMENT

Figure 1:
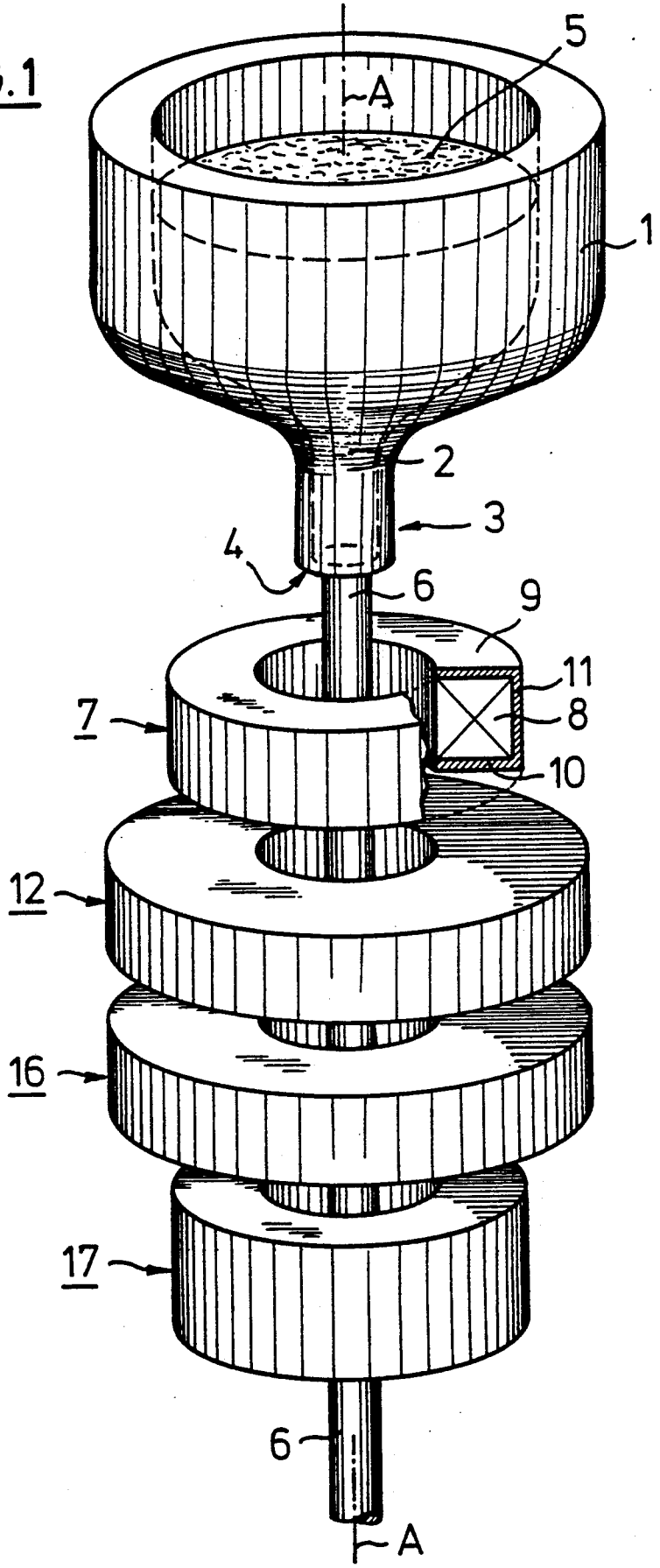
FIG. 1 is a perspective view of a complete apparatus of the invention with two rotating field generators.

In FIG. 1 shows a melt vessel 1 which is axially symmetrical and has the shape of a funnel. In its lower part, the melt vessel has a concentric outlet opening 2, to which is connected a vertical socket 3 with a lower edge 4 that lies in a horizontal plane. The melt vessel 1 is filled with a melt 5, which is held in the vessel for a limited time by a closing device (not show). Such a closing device may consist, for example, of a so-called stopper rod, which is passed from above through the melt 5 as far as the outlet opening 2, or also of an electromagnetic seal of the type known in the art.

The outlet opening 2 and the accompanying socket 3 are disposed on a vertical axis A—A of the system, which defines the path of fall of a pouring stream of molten metal 6.

In this path of fall, there is first of all a magnetic device 7, which is constructed in the form of an electron lens and thereby generates a continuous, axially symmetric magnetic field. For this purpose, the magnetic device 7 has a cylindrical coil 8, which is surrounded on three sides by a pole piece system. The pole piece consists of two radial, circular legs 9 and 10, as well as a yoke 11 that joins the legs 9 together at their outer diameter. Looked at in radial section, the legs 9 and 10 with the yoke 11 form a horseshoe magnet. The magnetic lines of flux emanating from this magnet form the inner part of a toroidal magnetic field, similar to that known from electron-optical lenses. Such a magnetic field has a stabilizing effect on the pouring stream of molten metal 6. Depending on the variation of the field strength with time and/or on the field strength as such, an additional constricting effect can also be exerted on the pouring stream of molten metal 6 with this magnetic device. Adjoining the magnetic device 7, at the bottom, is a further magnetic device 12, which is constructed as a rotating field generator. The center axis of this device is coaxial with the axis A—A of the outlet opening 2 and the axis of the system.

Figure 2:
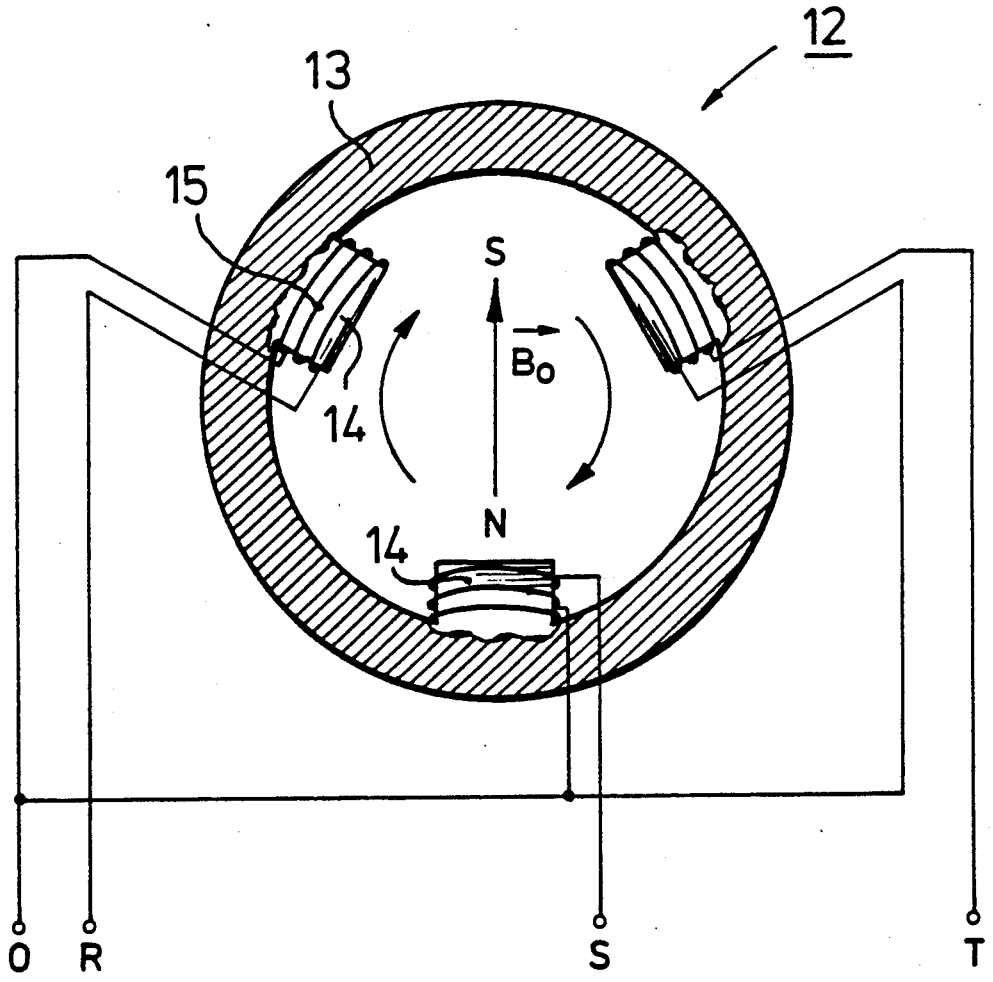
FIG. 2 is a horizontal section through one of the two rotating field generators.

The magnetic device 12 is illustrated in horizontal cross section in FIG. 2. It has a hollow, cylindrical yoke 13, from which extend three magnetic poles 14 are provided with coils 15. The arrangement has a laminated construction, as in the case of a three-phase motor. The individual coils 15 are connected as shown in the figure with the terminals R, S, T and O of a three-phase network or generator, so that a rotating magnetic field is developed in the interior of the device in a manner similar to that known from three-phase motors.

Adjoining the magnetic device 12 is a further magnetic device 16, which has the same construction as the magnetic device 12 and is thus also constructed as a rotating field generator. The arrangement is, however, made or connected so that there is a phase shift between the rotating field of magnetic device 16 and the rotating field of magnetic device 12.

Adjoining the lower rotating field magnetic device 16 is yet another magnetic device 17, the structure of which is similar to that of magnetic device 7; that is, it produces a continuous, axially symmetric magnetic field. The effect thus is similar to that of magnetic device 7 (electron lens). The arrangement illustrated in FIG. 1 has been extended axially in the form of an exploded diagram. In reality, this arrangement is shorter axially such that the magnetic fields are adjacent each other.

There has thus been shown and described a novel method and apparatus for the vertical casting of metal melts which fulfill all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the claims which follow.

We claim:

1. A method for casting metal melts from vessels with an outlet opening having a vertical axis, comprising forming a pouring steam of molten metal along said vertical axis from said outlet opening, and impressing a rotation in the stream of molten metal by means of a magnetic field which rotates about said vertical axis.

2. The method of claim 1, wherein said magnetic field rotates at a frequency of 50 to 500 Hz.

3. The method of claim 2, wherein said magnetic field includes two rotating fields which are disposed one above the other and which rotate at the same rate, but out of phase.

4. The method of claim 3, wherein the phase angle between said two fields is 90°.

5. Apparatus for casting metal melts comprising a vessel with an outlet opening having a vertical axis, and magnetic means for inducing a rotation in a stream of molten metal falling along said vertical axis from said outlet opening, said rotation being induced about said vertical axis.

6. The apparatus of claim 5, further comprising at least one additional magnetic device disposed coaxially with said magnetic means for the generation of a continuous, axially symmetric magnetic field.

7. Apparatus as in claim 1 where said magnetic means comprises magnetic field generating means for generating a magnetic field which rotates about said vertical axis.

8. The apparatus of claim 7, wherein said magnetic field generating means comprises at least two rotating magnetic field generators disposed coaxially one above the other.

9. The apparatus of claim 7, wherein said magnetic field generating means includes a stator having a yoke and 3n magnetic poles, n being an integer, which can be acted upon with three-phase current.

* * * * *

UNITED STATES PATENT AND TRADEMARK OFFICE

CERTIFICATE OF CORRECTION

PATENT NO. : 4,987,951

DATED : January 29, 1991

INVENTOR(S) : Walter Dietrich et al.

It is certified that error appears in the above-identified patent and that said Letters Patent is hereby corrected as shown below:

Col. 1, line 64, delete "passes an" and insert --passes and--.

Col. 6, line 3, (claim 3) delete "claim 2" and insert --claim 1--.

Col. 6, line 19, (claim 7) delete "claim 1" and insert --claim 5--.

Col. 5, line 27, (claim 1) delete "pouring steam" and insert --pouring stream--.

Signed and Sealed this

Twenty-second Day of June, 1993

*Attest:*

Michael K. Kirk

MICHAEL K. KIRK

*Attesting Officer*

*Acting Commissioner of Patents and Trademarks*